US011208932B2

(12) United States Patent
Maeda et al.

(10) Patent No.: US 11,208,932 B2
(45) Date of Patent: Dec. 28, 2021

(54) CATALYST DEVICE

(71) Applicant: HONDA MOTOR CO., LTD., Tokyo (JP)

(72) Inventors: Kazuhisa Maeda, Wako (JP); Hiroyuki Horimura, Wako (JP); Toshiaki Kimura, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 17/266,124

(22) PCT Filed: Aug. 6, 2019

(86) PCT No.: PCT/JP2019/030840
§ 371 (c)(1),
(2) Date: Feb. 5, 2021

(87) PCT Pub. No.: WO2020/132003
PCT Pub. Date: Feb. 13, 2020

(65) Prior Publication Data

US 2021/0310396 A1 Oct. 7, 2021

(30) Foreign Application Priority Data

Aug. 10, 2018 (JP) ..... JP2018-151744

(51) Int. Cl.
*F01N 3/28* (2006.01)

(52) U.S. Cl.
CPC ..... *F01N 3/2839* (2013.01); *F01N 3/2814* (2013.01)

(58) Field of Classification Search
CPC ..... F01N 3/2839; F01N 3/2814; F01N 3/28
(Continued)

(56) References Cited

U.S. PATENT DOCUMENTS 4,152,302 A * 5/1979 Nonnenmann ..... F01N 3/2814 502/338
5,130,208 A * 7/1992 Maus ..... F01N 3/2821 428/593

(Continued)

FOREIGN PATENT DOCUMENTS

JP 06-254413 9/1994
JP 08-103664 4/1996

(Continued)

OTHER PUBLICATIONS

International Search Report and Written Opinion for International Application No. PCT/JP2019/030840 dated Oct. 8, 2019, 12 pages.

*Primary Examiner* — Tom P Duong
(74) *Attorney, Agent, or Firm* — Amin, Turocy & Watson, LLP

(57) ABSTRACT

Provided is a catalyst device that can equalize the strength of a carrier in the direction of the flow of exhaust gas. According to the present invention, a flat plate and a corrugated plate have a plurality of holes. When the flat plate and the corrugated plate are in a flat state before being made into a carrier, the plurality of holes form: a plurality of first rows that run along a first direction that is parallel to the axial direction of the carrier; and a plurality of second rows that run along a second direction that is orthogonal to the first direction. As seen from the second direction, the holes in one second row and the holes in the other second row of adjacent second rows have portions that overlap each other.

2 Claims, 8 Drawing Sheets

(58) Field of Classification Search
USPC ..... 422/177
See application file for complete search history.

(56) References Cited

U.S. PATENT DOCUMENTS

| | | | | |
|---|---|---|---|---|
| 5,436,216 | A * | 7/1995 | Toyao | F01N 3/2026 502/439 |
| 5,514,347 | A | 5/1996 | Ohashi et al. | |
| 5,599,509 | A | 2/1997 | Toyao et al. | |
| 5,648,050 | A * | 7/1997 | Matsumoto | B01J 35/04 422/169 |
| 5,791,043 | A * | 8/1998 | Okabe | B01J 35/04 156/209 |
| 5,820,832 | A * | 10/1998 | Huttenhofer | F15D 1/14 422/171 |
| 6,299,845 | B1 * | 10/2001 | Romatier | B01D 3/009 261/112.2 |
| 6,761,980 | B2 * | 7/2004 | Sato | B01J 35/04 29/890 |
| 7,030,059 | B2 * | 4/2006 | Tanabe | B01J 35/04 422/180 |
| 7,083,860 | B2 * | 8/2006 | Maus | B01J 35/04 422/180 |
| 7,981,498 | B2 * | 7/2011 | Maus | F01N 3/0222 428/116 |
| 9,381,467 | B2 * | 7/2016 | Murawaki | B01J 23/892 |
| 2004/0121908 | A1 * | 6/2004 | Tanabe | F01N 3/2821 502/439 |

FOREIGN PATENT DOCUMENTS

| | | |
|---|---|---|
| JP | 2000-093806 | 4/2000 |
| JP | 2005-535454 | 11/2005 |
| JP | 2014-147879 | 8/2014 |

* cited by examiner

CATALYST DEVICE

TECHNICAL FIELD

The present invention relates to a catalyst device that is formed by a flat plate and a corrugated plate being stacked and rolled and supports a catalyst support that supports a catalyst by housing the catalyst support in an outer cylinder.

BACKGROUND ART

A vehicle provided with an internal combustion engine includes an exhaust system for discharging out of the vehicle exhaust gas that is generated in a combustion process of the internal combustion engine. The exhaust system includes a catalyst device that cleans up the exhaust gas. In Japanese Laid-Open Patent Publication No. 2014-147879, a catalyst device for a small internal combustion engine that is provided in a motorcycle is disclosed. This catalyst device includes a catalyst support that supports a catalyst and an outer cylinder that supports the catalyst support by housing the catalyst support. The catalyst support is formed by a thinned metal flat plate and a thinned metal corrugated plate being stacked and rolled. A position where the flat plate and the corrugated plate are joined and a position where the catalyst support and the outer cylinder are joined are located closer to the upstream side of the exhaust gas flow. Japanese Laid-Open Patent Publication No. 2005-535454 (PCT) discloses a honeycomb body with holes (a catalyst support) that is formed by flat thin plate (flat plate) and corrugated thin plate (corrugated plate), each plate having holes.

SUMMARY OF INVENTION

A catalyst support with holes has nonuniform strength: a portion with a hole is weaker than a portion without a hole. As shown in Japanese Laid-Open Patent Publication No. 2005-535454 (PCT), if portions with holes and portions without holes are not uniformly distributed in the direction of the exhaust gas flow, a weaker portion where a hole exists (a board between holes) could buckle due to thermal stress caused in the catalyst support by the discharging of the exhaust gas.

The present invention has been made in view of such problems and an object thereof is to provide a catalyst device in which a catalyst support has uniform strength in the direction in which exhaust gas flows.

The present invention is a catalyst device including:

a catalyst support that is formed by a thinned metal flat plate and a thinned metal corrugated plate being stacked and rolled and that supports a catalyst; and an outer cylinder that houses the catalyst support therein and supports the catalyst support with one end of the catalyst support made to face an upstream side of exhaust gas and another end of the catalyst support made to face a downstream side of the exhaust gas, wherein the flat plate and the corrugated plate include a plurality of holes, in a flat state in which the flat plate and the corrugated plate are not yet shaped into the catalyst support, the plurality of holes form a plurality of first lines by being aligned in a first direction that is parallel to a direction of an axis of the catalyst support and form a plurality of second lines by being aligned in a second direction that is orthogonal to the first direction, of two adjacent second lines out of the plurality of second lines, the holes on one second line and the holes on the other second line overlap each other by portions when viewed from the second direction.

According to the present invention, the exhaust gas can efficiently be cleaned up while the strength of the catalyst support is not lowered.

DESCRIPTION OF EMBODIMENTS

Hereinafter, preferred embodiments of a catalyst device according to the present invention will be described in detail with reference to the accompanying drawings.

In the descriptions below, upstream and downstream are defined with respect to the flow of exhaust gas.

[1. Exhaust System 14]

Figure 1:
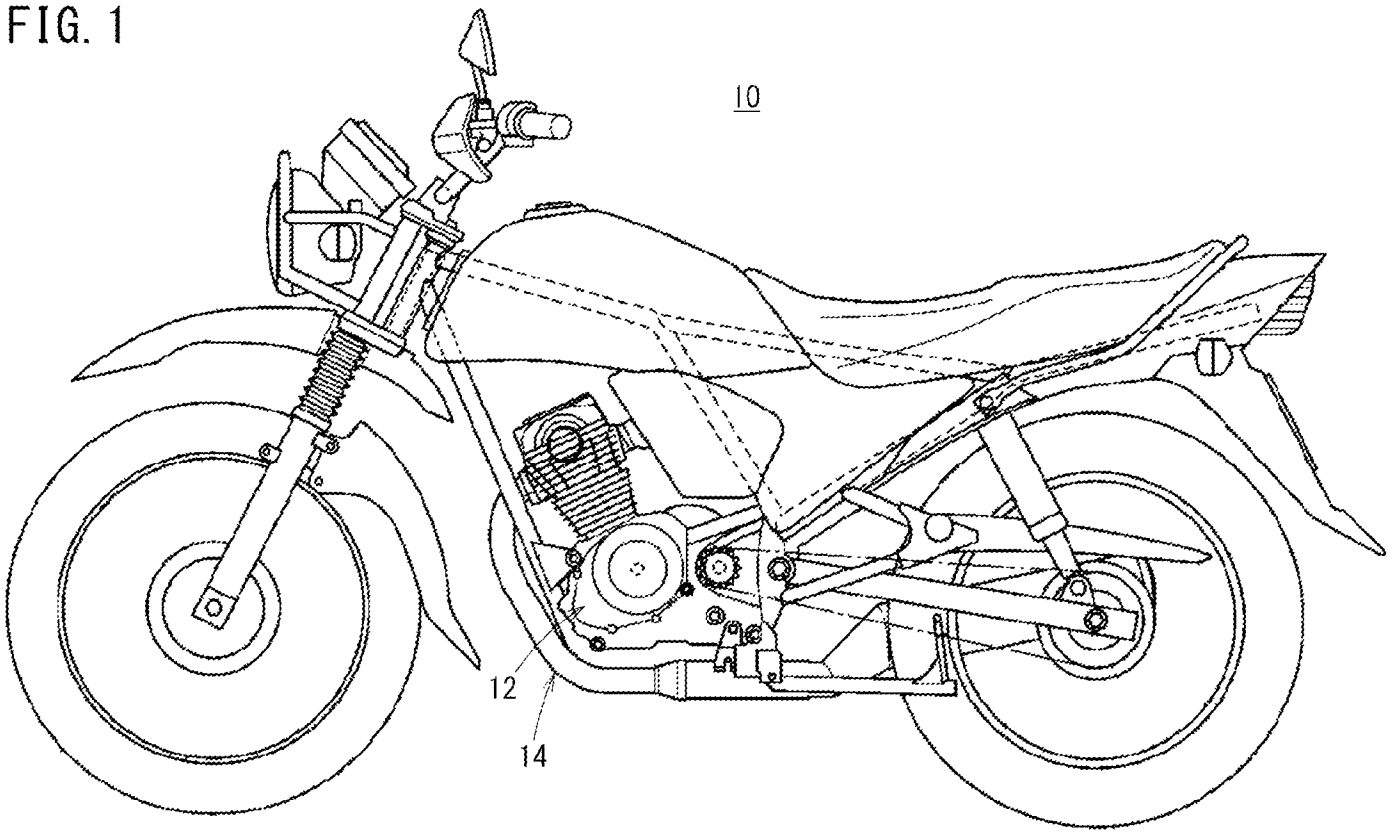
FIG. 1 is a left side view of a motorcycle.

As depicted in FIG. 1, a motorcycle 10 includes an internal combustion engine 12 as a drive source for travel. To the internal combustion engine 12, an exhaust system 14 is connected.

Figure 2:
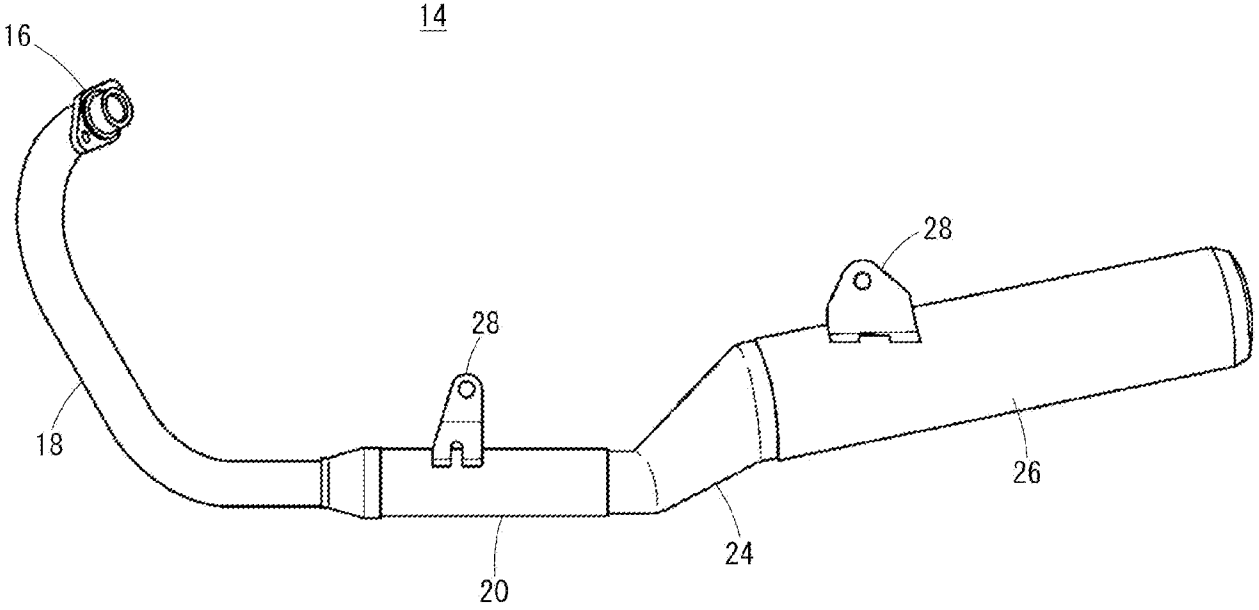
FIG. 2 is a left side view of an exhaust system.

As depicted in FIG. 2, the exhaust system 14 includes a flange 16, an upstream-side exhaust pipe 18, a catalyst storing portion 20, a downstream-side exhaust pipe 22 (FIG. 3), a heat shield cover 24, and a muffler 26. The upstream-side exhaust pipe 18 is connected to a cylinder head of the internal combustion engine 12 by the flange 16. The catalyst storing portion 20 is connected to a downstream-side end of the upstream-side exhaust pipe 18. The configuration of the catalyst storing portion 20 will be described in [2] below. The downstream-side exhaust pipe 22 (FIG. 3) is connected to a downstream-side end of the catalyst storing portion 20. The heat shield cover 24 is connected to the downstream-side end of the catalyst storing portion 20 in such a way as to cover the downstream-side exhaust pipe 22. The muffler 26 is connected to downstream-side ends of the downstream-side exhaust pipe 22 and the heat shield cover 24. The exhaust system 14 is attached to a frame of a vehicle body by one or more stays 28. With this structure, exhaust gas that is discharged from the internal combustion engine 12 is discharged to the outside after passing through the upstream-side exhaust pipe 18, the catalyst storing portion 20, the downstream-side exhaust pipe 22, and the muffler 26.

[2. Catalyst Storing Portion 20]

Figure 3:
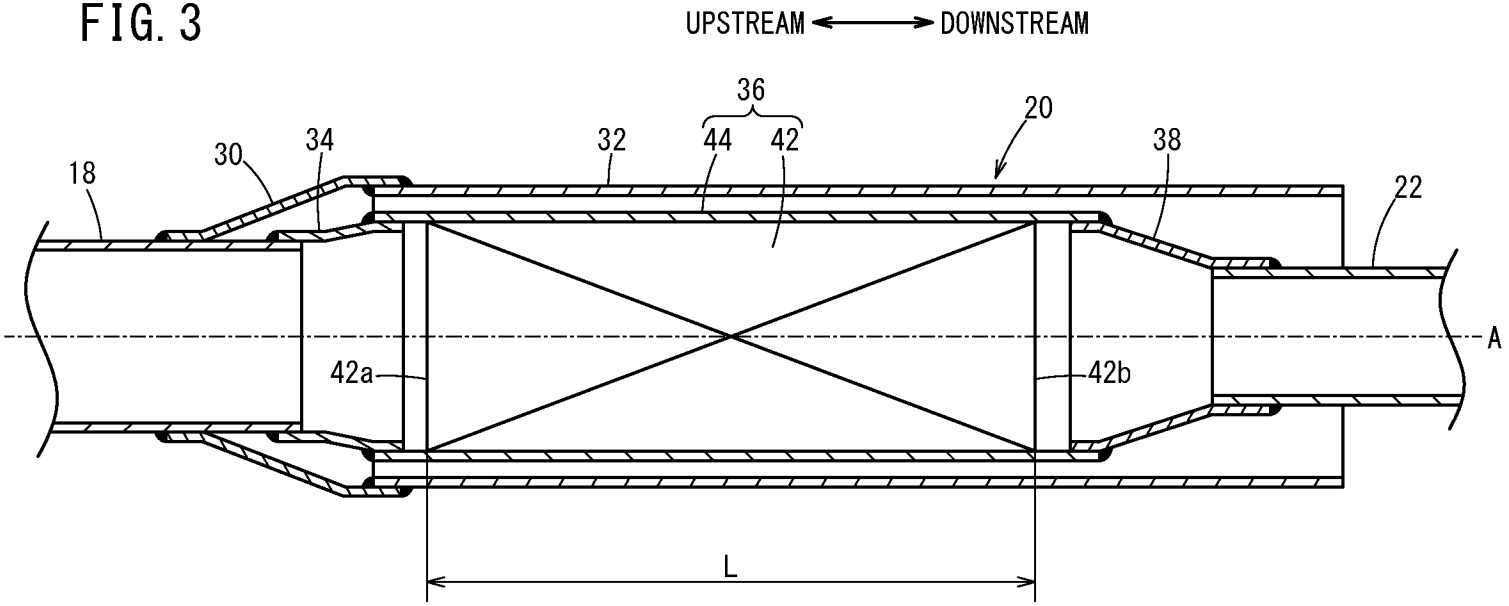
FIG. 3 is a sectional view of a catalyst storing portion.

As depicted in FIG. 3, the catalyst storing portion 20 includes an outer taper pipe 30, a heat shield pipe 32, an upstream-side inner taper pipe 34, a catalyst device 36, and a downstream-side inner taper pipe 38. The outer taper pipe 30 is connected to the downstream-side end of the upstream-side exhaust pipe 18. The heat shield pipe 32 is connected to a downstream-side end of the outer taper pipe 30. The upstream-side inner taper pipe 34 is connected to the downstream-side end of the upstream-side exhaust pipe 18 at a downstream site from a connection between the outer taper pipe 30 and the upstream-side exhaust pipe 18, and is located inside the outer taper pipe 30. The catalyst device 36 is connected to a downstream-side end of the upstream-side inner taper pipe 34 and located inside the heat shield pipe 32. The configuration of the catalyst device 36 will be described in [3] below. The downstream-side inner taper pipe 38 is connected to a downstream-side end of the catalyst device 36 and located inside the heat shield pipe 32.

[3. Catalyst Device 36]

Figure 4:
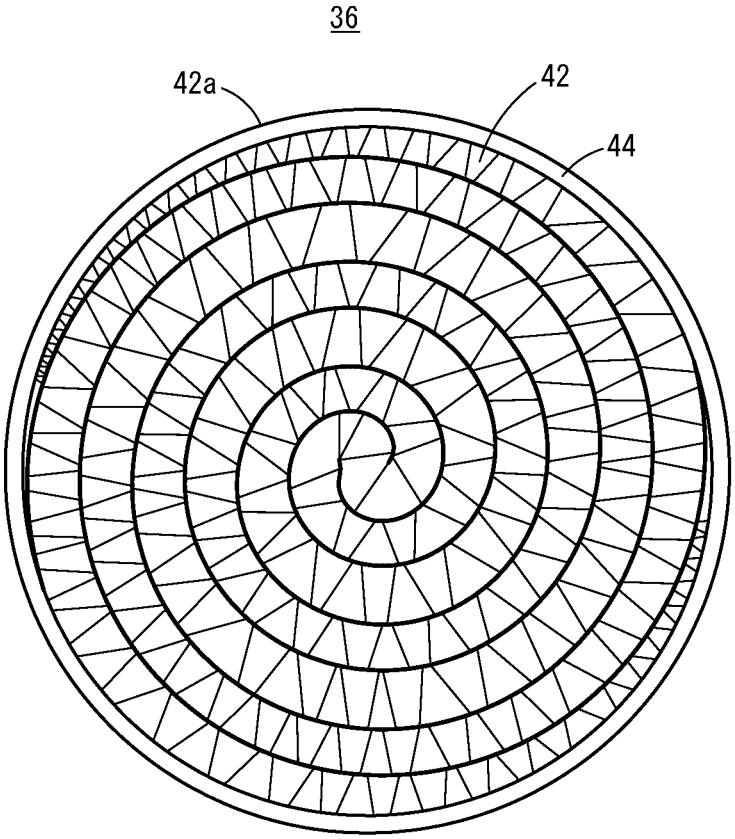
FIG. 4 is a schematic diagram schematically depicting a catalyst device viewed from an upstream side.

As depicted in FIGS. 3 and 4, the catalyst device 36 includes a catalyst support 42 and an outer cylinder 44. The catalyst support 42 is substantially in the shape of a cylinder having a honeycomb structure and is formed by one or more thinned metal flat plates 52 (FIG. 8) and one or more corrugated plates 54 (FIG. 8) that are corrugated thinned metal flat plates 52, with the thinned metal flat plates 52 and the corrugated plates 54 being stacked and rolled. Each flat plate 52 (and each corrugated plate 54) is formed of stainless steel and has a plurality of holes 64 (FIG. 5) passing therethrough from one side to the other side. The holes 64 will be described in [3.1] below.

The catalyst support 42 supports a catalyst. For example, in the state of the catalyst support 42, the surfaces of the flat plate 52 and the corrugated plate 54 are covered with coating containing a catalytic material (for instance, elements of the platinum group, such as platinum, palladium, and rhodium). The flat plate 52 and the corrugated plate 54 are joined to each other. Joining of the flat plate 52 and the corrugated plate 54 will be described in [3.2] below.

The outer cylinder 44 is a cylinder whose inner diameter is slightly larger than the outer diameter of the catalyst support 42. As in the case of the flat plate 52, the outer cylinder 44 is formed of stainless steel. The outer cylinder 44 houses the catalyst support 42. The outer cylinder 44 supports the catalyst support 42 in a state in which one end 42*a* of the catalyst support 42 is made to face the upstream side of the exhaust gas and the other end 42*b* of the catalyst support 42 is made to face the downstream side of the exhaust gas. In a state in which the outer cylinder 44 is supporting the catalyst support 42, the axis of the outer cylinder 44 and the axis of the catalyst support 42 coincide with each other. As depicted in FIG. 3, the axis of the outer cylinder 44 and the catalyst support 42 is referred to as an axis A. The outer circumferential surface of the catalyst support 42 and the inner circumferential surface of the outer cylinder 44 are joined to each other. Joining of the catalyst support 42 and the outer cylinder 44 will be described in [3.2] below.

[3.1. Flat Plate 52 with Holes 64]

Figure 5:
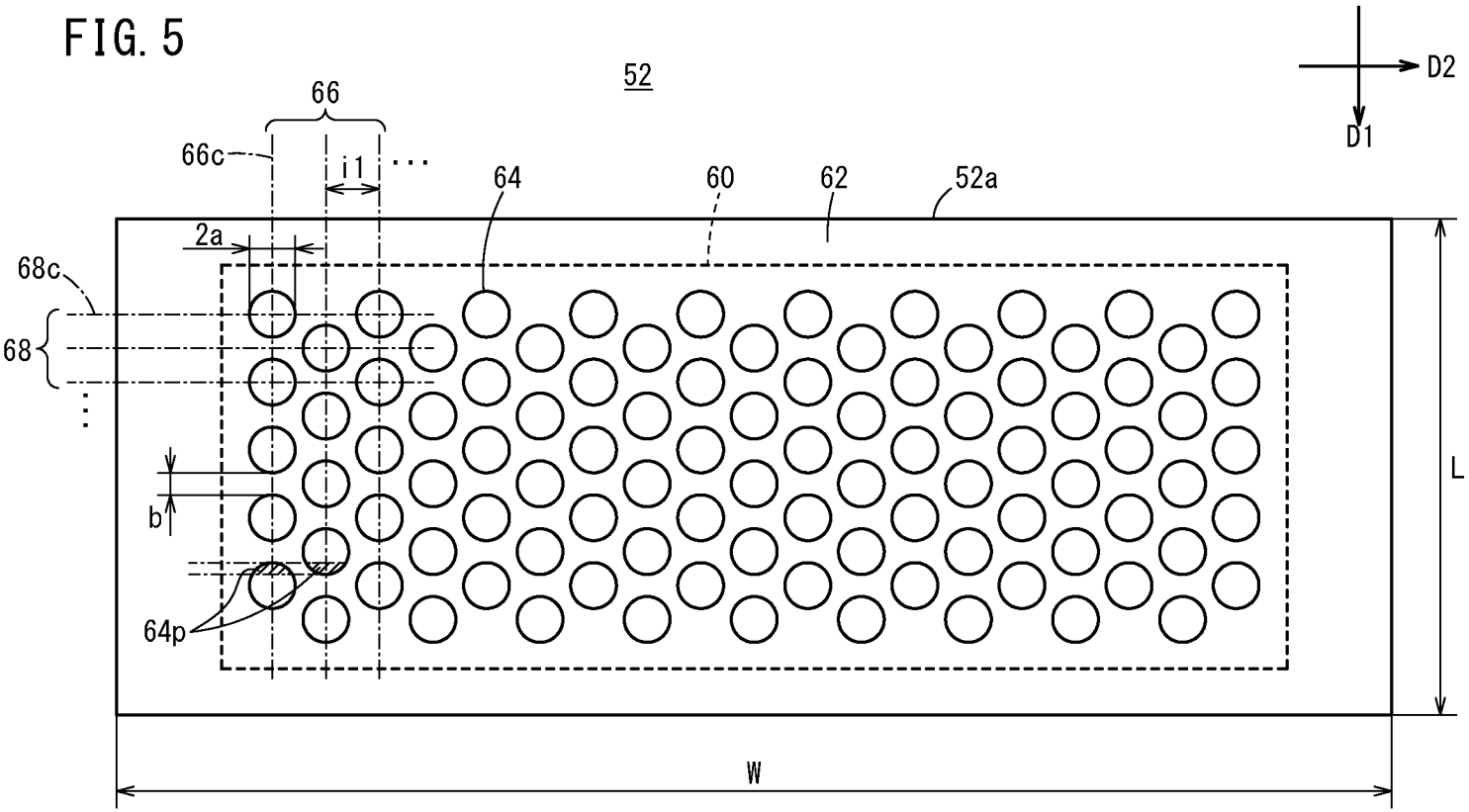
FIG. 5 is a schematic diagram schematically depicting a flat plate.

The flat plate 52 will be described by using FIG. 5. The flat plate 52 depicted in FIG. 5 is in a flat state in which the flat plate 52 is not yet shaped into the catalyst support 42. The flat plate 52 is a substantially rectangular thinned metal member of a length L in a first direction D1 and a length W (>L) in a second direction D2. The first direction D1 is parallel to the direction of the flow of the exhaust gas and the direction of the axis of the catalyst support 42 (a direction in which the axis A extends). In FIG. 5, a direction from the top to the bottom on the plane of paper is assumed to be the first direction D1. The second direction D2 is orthogonal to the first direction D1. In FIG. 5, a direction from the left to the right on the plane of paper is assumed to be the second direction D2. The length L of the flat plate 52 in the first direction D1 is the length of the catalyst support 42 in the direction of the axis thereof. The length W of the flat plate 52 in the second direction D2 is related to the diameter of the catalyst support 42. Therefore, the length L and the length W are determined in accordance with the design of the catalyst support 42.

The flat plate 52 has a hole formation portion 60 and an edge portion 62 surrounding the hole formation portion 60. The flat plate 52 has, in the hole formation portion 60, a plurality of holes 64 aligning in the first direction D1 and the second direction D2. A line of the holes 64 in the first direction D1 is referred to as a first line 66. A line of the holes 64 in the second direction D2 is referred to as a second line 68. When a line connecting the centers of the holes 64 in the first line 66 is called a center line 66*c* of the line, the holes 64 are arranged in such a way that the center lines 66*c* are spaced uniformly. When a line connecting the centers of the holes 64 in the second line 68 is called a center line 68*c* of the line, the holes 64 are arranged in such a way that the center lines 68*c* are spaced uniformly.

The first lines 66 are numbered consecutively toward the second direction D2. The holes 64 on an n-th first line 66 and the holes 64 on an n+1-th first line 66 alternately form a line when viewed from one (or the other) side of the second direction D2. That is, when viewed from one (or the other) side of the second direction D2, one hole 64 of the n+1-th first line 66 is disposed between two holes 64 that are adjacent to each other in the n-th first line 66 and one hole 64 of the n-th first line 66 is disposed between two holes 64 that are adjacent to each other in the n+1-th first line 66.

Likewise, the second lines 68 are numbered consecutively from one side to the other side in the first direction D1. The holes 64 on an n-th second line 68 and the holes 64 on an n+l-th second line 68 alternately form a line when viewed from one (or the other) side of the first direction D1. That is, when viewed from one (or the other) side in the first direction D1, one hole 64 of the n+l-th second line 68 is disposed between two holes 64 that are adjacent to each other in the n-th second line 68 and one hole 64 of the n-th second line 68 is disposed between two holes 64 that are adjacent to each other in the n+1-th second line 68.

Of two (n-th and n+1-th) adjacent first lines 66, the holes 64 on one (n-th) first line 66 and the holes 64 on the other (n+1-th) first line 66 are separated from each other when viewed from the first direction D1. On the other hand, of two (n-th and n+1-th) second lines 68, the holes 64 on one (n-th) second line 68 and the holes 64 on the other (n+1-th) second line 68 overlap each other by portions 64*p* when viewed from the second direction D2. The length of each of the overlapping portions 64*p* in the first direction D1 is more than 0 and is less than or equal to 20% of the length (for instance, the diameter 2*a*) of the holes 64 in the second direction D2.

Here, a specific example of the flat plate 52 will be described. The hole 64 is circular in shape. The radius a of the hole 64 is 4.0 mm (the diameter thereof is 8.0). The interval i1 between the first lines 66 that are adjacent to each other (that is, the interval i1 between an n-th first line 66 and an n+1-th first line 66) is 9.52 mm. The distance b between the ends of two holes 64 that are adjacent to each other is 3 mm. The length of the portions 64*p* is equal to or more than 10% of the length of the holes 64 in the first direction D1.

These shapes and numerical values are given by way of example and other shapes and numerical values may be adopted. For instance, the hole 64 may be oval in shape; in that case, any one of the major axis and the minor axis may be parallel to the first direction D1 or the second direction D2.

Moreover, the size (for example, the diameter 2*a*) of the holes 64 that are disposed in the region of the portions 64*p* may be smaller than the size (for example, the diameter 2*a*) of the holes 64 that are disposed in another region. In particular, it is preferable to make smaller the size of the holes 64 included in given second lines 68 (1st to k-th second lines 68) counted up from the second line 68 on the upstream side, that is, from a first end 52*a* side that is the one end 42*a* of the catalyst support 42. Specifically, when the hole 64 is circular in shape, the size and arrangement of the holes 64 can be set so that a relation, the distance b>the radius a, holds. Making smaller the size of the holes 64 on the upstream side increases durability to withstand the vibration (that is called fluttering) of the catalyst support 42 caused by pulsation of the exhaust gas.

Figure 6:
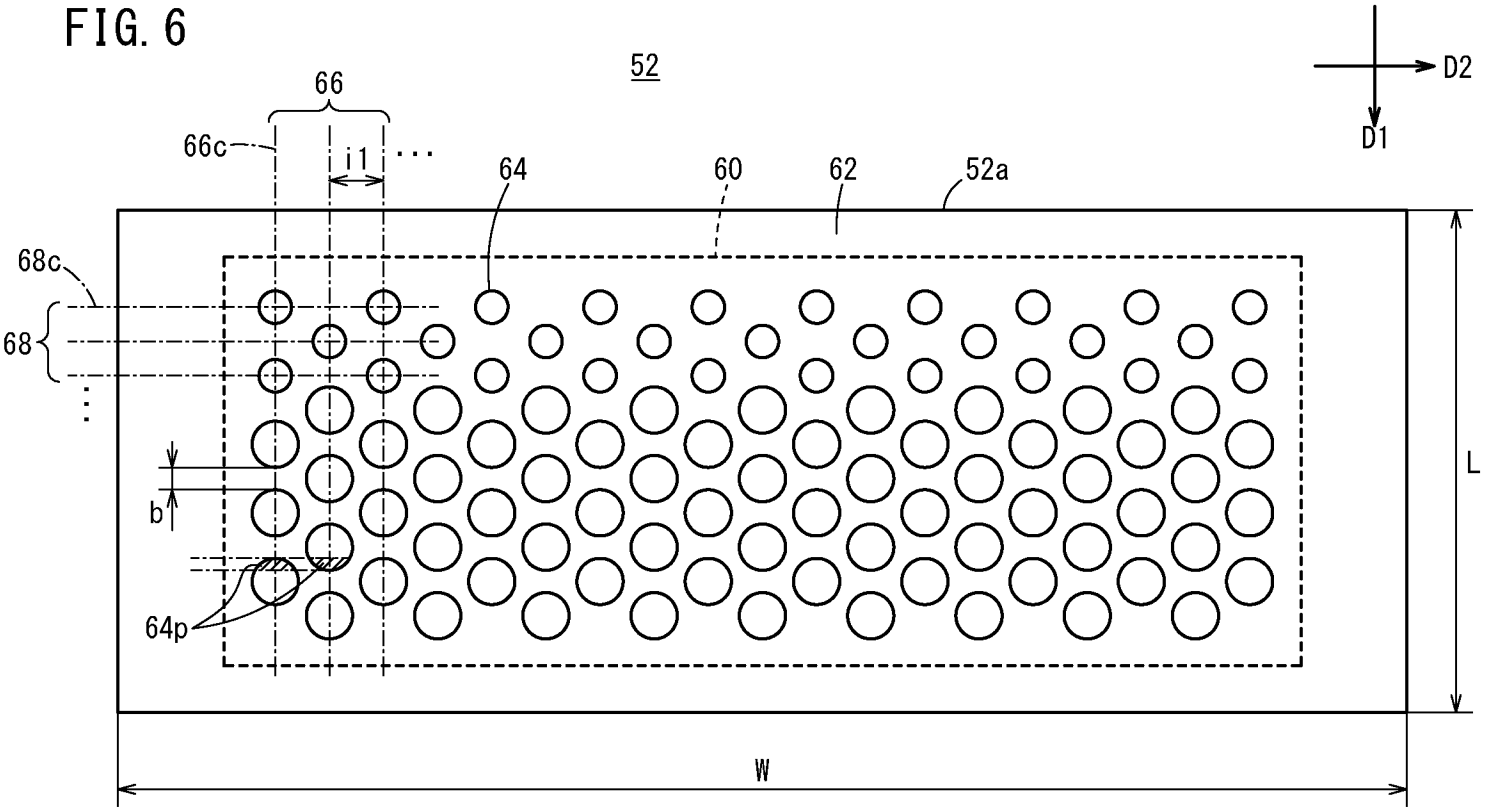
FIG. 6 is a schematic diagram schematically depicting a flat plate having smaller holes in an upstream side.

The flat plate 52 shown in FIG. 6 has smaller holes 64 in the second lines 68 from the first end 52*a* side, which is the upstream side, to the third one (in the first to third second lines 68). For example, the radius a of the holes 64 is 3.4 mm (the diameter thereof is 6.8). The interval i1 between the adjacent first lines 66 is 9.52 mm. The distance b between ends of two adjacent holes 64 is 4.2 mm.

The corrugated plate 54 is formed by elongating the flat plate 52 in the second direction D2 into a thinned metal member and processing the thinned metal member into the form of waves arranged in the second direction D2. The outer shape of the corrugated plate 54 is substantially the same as that of the flat plate 52 when viewed in a plan view. Amplitude of the waves of the corrugated plate 54 gradually increases and decreases: the waves of the corrugated plate 54 forms, for example, a sinusoidal wave. The holes 64 of the corrugated plate 54 are arranged in the same manner as those of the flat plate 52. However, since the corrugated plate 54 is longer than the flat plate 52 in the second direction D2, the hole formation portion 60 is wider in the second direction D2 and there are more holes 64.

In a case where the flat plate 52 and the corrugated plate 54 are formed with the holes 64, turbulence (vortices, eddies) is likely to occur in the exhaust gas flowing in the catalyst support 42. The exhaust gas more frequently contacts the catalyst once the turbulence occurs in the exhaust gas, whereby the efficiency of the cleanup of the exhaust gas improves. Moreover, in a case where the flat plate 52 and the corrugated plate 54 are formed with the holes 64, the flow path of the exhaust gas effectively becomes longer. The exhaust gas more frequently contacts the catalyst once the flow path of the exhaust gas becomes longer, whereby the efficiency of the cleanup of the exhaust gas improves.

[3.2. Joining of the Members]

Figure 7:
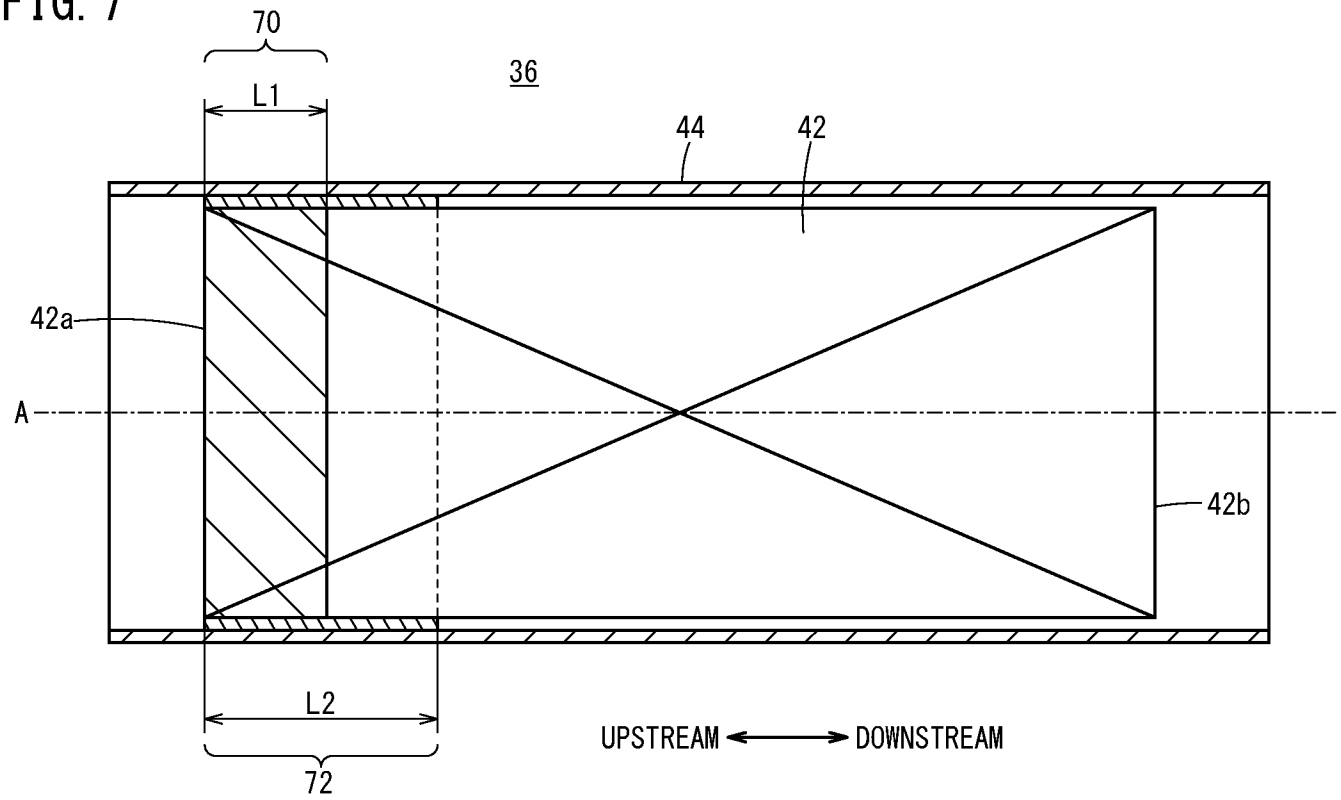
FIG. 7 is an explanatory diagram of a brazing part.

Joining of the flat plate 52 and the corrugated plate 54 and joining of the catalyst support 42 and the outer cylinder 44 will be described by using FIG. 7. FIG. 7 shows joint areas of the members in the catalyst device 36 depicted in FIG. 3. The flat plate 52 and the corrugated plate 54 are joined together by brazing, and the catalyst support 42 and the outer cylinder 44 are also joined together by brazing.

In the present embodiment, a portion on the upstream side in which the flat plate 52 and the corrugated plate 54 are brazed to one another is referred to as a first upstream area 70 and a portion in which the catalyst support 42 and the outer cylinder 44 are brazed to one another is referred to as a second upstream area 72. The first upstream area 70 is an area that spreads from the position of the one end 42*a* of the catalyst support 42 to a position that is away therefrom by a length L1 to the downstream side in the direction of the axis. The second upstream area 72 is an area that spreads from the position of the one end 42*a* of the catalyst support 42 to a position away therefrom by a length L2 to the downstream side in the direction of the axis. The length L2 is longer than the length L1. That is, the second upstream area 72 is wider than the first upstream area 70 to the downstream side in the direction of the axis.

In the catalyst support 42 located in the first upstream area 70, the flat plate 52 and the corrugated plate 54 are brazed to each other from the center to the outer circumference. The first upstream area 70 contains the edge portions 62 of the flat plate 52 and the corrugated plate 54 and a plurality of holes 64 on the first to k-th (given ordinal number) second lines 68. Substantially peak parts of wave portions included in the corrugated plate 54 are brazed to the flat plate 52. However, it is difficult to braze all the contact points between the flat plate 52 and the corrugated plate 54 that are included in the first upstream area 70. For this reason, in the present embodiment, brazing all the contact points is not required.

The catalyst support 42 and the outer cylinder 44 that are located in the second upstream area 72 are brazed to each other. Specifically, the outer circumferential surface of the catalyst support 42 and the inner circumferential surface of the outer cylinder 44 are brazed to one another.

The closer to the upstream side, the greater the vibration of the catalyst device 36 is. By joining the flat plate 52 and the corrugated plate 54 together in the first upstream area 70 and joining the catalyst support 42 and the outer cylinder 44 together in the second upstream area 72 as in the present embodiment, it is possible to efficiently suppress the vibration of the catalyst support 42. Furthermore, since the members are not joined together along the length of the catalyst support 42, it is possible to prevent the catalyst support 42 from being damaged as a result of the members expanding and contracting under the influence of heat.

[4. Method for Producing Catalyst Device 36]

Figure 8:
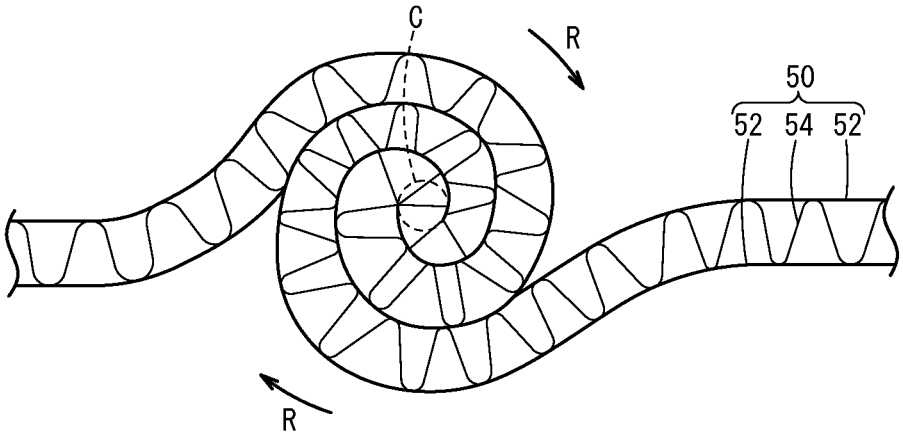
FIG. 8 is an explanatory diagram for a manufacturing method of the catalyst support.

As depicted in FIG. 8, by supporting with a support member a central portion C of a stacked body 50 that is formed by stacking the flat plate 52 on both sides of the corrugated plate 54, and by rotating the support member, the central portion C is rotated in one direction R, whereby the catalyst support 42 in which the stacked body 50 is stacked from the center toward the radial direction is formed. In so doing, the flat plate 52 and the corrugated plate 54 are brazed to one another and the catalyst support 42 is formed into a substantially cylindrical shape.

The stacked body 50 may be a plurality of layers formed of a plurality of flat plates 52 and a plurality of corrugated plates 54 that are alternately stacked. Moreover, as described in Japanese Laid-Open Patent Publication No. 2014-147879 mentioned above, the catalyst support 42 may be formed by supporting an end of the stacked body 50 with the support member and by rotating the support member in the direction R.

Next, the substantially cylindrical catalyst support 42 is inserted into the outer cylinder 44 and the catalyst support 42 and the outer cylinder 44 are brazed to one another.

Next, a high-viscosity mixed solution containing the catalytic material is placed on the side of the catalyst support 42 where the one end 42*a* thereof is located, and a difference in pressure is generated by making the atmospheric pressure on the side where the other end 42*b* is located lower than the atmospheric pressure on the side where the one end 42*a* is located. Then, the mixed solution is sucked to the side where the other end 42*b* is located, whereby the mixed solution enters the honeycomb catalyst support 42 from the side where the one end 42*a* is located. When passing through the inside of the catalyst support 42, the mixed solution is sucked to the side where the other end 42*b* is located while making contact with the front surfaces of the flat plate 52 and the corrugated plate 54. As a result, the inner surface of the catalyst support 42 (the surfaces of the flat plate 52 and the corrugated plate 54) is covered with a coating containing the catalytic material.

[5. Invention Obtained by the Embodiment]

An invention that can be understood from the above-mentioned embodiment will be described below.

The present invention is the catalyst device 36 including:

the catalyst support 42 that is formed by the thinned metal flat plate 52 and the thinned metal corrugated plate 54 being stacked and rolled and that supports a catalyst; and the outer cylinder 44 that houses the catalyst support 42 therein and supports the catalyst support 42 with the one end 42*a* of the catalyst support 42 made to face an upstream side of exhaust gas and the other end 42*b* of the catalyst support 42 made to face a downstream side of the exhaust gas, wherein the flat plate 52 and the corrugated plate 54 include the plurality of holes 64, in a flat state in which the flat plate 52 and the corrugated plate 54 are not yet shaped into the catalyst support 42, the plurality of holes 64 form the plurality of first lines 66 by being aligned in the first direction D1 that is parallel to a direction of an axis of the catalyst support 42 and form the plurality of second lines 68 by being aligned in the second direction D2 that is orthogonal to the first direction D1, of two adjacent second lines 68 out of the plurality of second lines 68, the holes 64 on one second line 68 and the holes 64 on the other second line 68 overlap each other by the portions 64*p* when viewed from the second direction D2.

According to the structure above, holes 64 on one second line 68 and holes 64 on another second line 68 overlap each other by a portion 64*p* when viewed from the second direction D2. In other words, the second lines 68 are arrayed along the first direction D1 (the direction of the flow of the exhaust gas), overlapping each other. As a result, when viewed from the second direction D2, there is no portion where the holes 64 do not appear and thus the strength of the catalyst support 42 in the first direction D1 is made uniform.

In the present invention, a length of each of the portions 64*p* is equal to or more than 10% of a length of each of the holes 64 in the first direction D1.

When the length of a portion 64*p* as viewed in the second direction D2 is set equal to or more than 10% of the length of a hole 64 in the first direction D1, the nonuniform strength of the catalyst support 42 can more effectively prevented when the catalyst support 42 is formed.

In the present invention, the holes 64 contained in a given number of second lines 68 counted from a side of the one end 42*a* are larger in size than the holes 64 contained in subsequent second lines 68 following the given number of second lines 68.

It goes without saying that the catalyst device according to the present invention is not limited to the above-described embodiments and can adopt various configurations within the scope of the present invention.

What is claim is:

1. A catalyst device comprising:

a catalyst support that is formed by a thinned metal flat plate and a thinned metal corrugated plate being stacked and rolled and that supports a catalyst; and an outer cylinder that houses the catalyst support therein and supports the catalyst support with one end of the catalyst support made to face an upstream side of exhaust gas and another end of the catalyst support made to face a downstream side of the exhaust gas, wherein the flat plate and the corrugated plate include a plurality of holes, in a flat state in which the flat plate and the corrugated plate are not yet shaped into the catalyst support, the plurality of holes form a plurality of first lines by being aligned in a first direction that is parallel to a direction of an axis of the catalyst support and form a plurality of second lines by being aligned in a second direction that is orthogonal to the first direction, of two adjacent second lines out of the plurality of second lines, the holes on one second line and the holes on the other second line overlap each other by portions when viewed from the second direction, and wherein the holes contained in a given number of second lines counted from a side of the one end are larger in size than the holes contained in subsequent second lines following the given number of second lines.

2. The catalyst device according to claim 1, wherein a length of each of the portions is equal to or more than 10% of a length of each of the holes in the first direction.

* * * * *